United States Patent [19]

Nomura

[11] 4,253,172

[45] Feb. 24, 1981

[54] ELECTRONIC TIMEPIECE OR ANALOG TYPE

[75] Inventor: Yasushi Nomura, Tokorozawa, Japan

[73] Assignee: Citizen Watch Company Limited, Tokyo, Japan

[21] Appl. No.: 960,743

[22] Filed: Nov. 15, 1978

[30] Foreign Application Priority Data

Nov. 17, 1977 [JP] Japan ..... 52/154355[U]

[51] Int. Cl.[3] ..... G04B 23/02; G04C 21/00; G04C 21/16

[52] U.S. Cl. ..... 368/72; 368/76; 368/249; 368/250

[58] Field of Search ..... 58/19 R, 38 R, 23 R, 58/23 D, 22.7, 57.5, 152 B, 50 R, 127 R

[56] References Cited

U.S. PATENT DOCUMENTS

| | | | |
|---|---|---|---|
| 3,292,360 | 12/1966 | Mahon | 58/22.7 |
| 3,780,522 | 12/1973 | Yosaida | 58/38 R |
| 3,834,153 | 9/1974 | Yoda et al. | 58/38 R |
| 3,945,191 | 3/1976 | Van Berkum | 58/4 A |
| 4,015,417 | 4/1977 | Kitai et al. | 58/22.7 |
| 4,044,544 | 8/1977 | Yagi et al. | 58/23 R |
| 4,069,658 | 1/1978 | Ito | 58/16 R |
| 4,099,371 | 7/1978 | Mochizuki et al. | 58/22.7 |
| 4,129,981 | 12/1978 | Nomura et al. | 58/23 D |
| 4,143,361 | 3/1979 | Kimura | 58/50 R |

*Primary Examiner*—Vit W. Miska
*Attorney, Agent, or Firm*—Holman & Stern

[57] ABSTRACT

An electronic timepiece of analog type display provided with alarm means and a switch for setting or cancelling said alarm means, and with an indication being given as to whether the timepiece is in the alarm set or alarm cancelled status, by modulating the advancement of the seconds hand

5 Claims, 13 Drawing Figures

ELECTRONIC TIMEPIECE OR ANALOG TYPE

This invention relates in general to electronic timepieces of analog display type equipped with an alarm function, and in particular to a means of indicating to the timepiece user whether an alarm time has been previously set.

At present, there are various designs of electronic timepieces, consisting primarily of electronic wristwatches, in which time is displayed in analog fashion, i.e. by means of hours, minutes and seconds hands. Such a timepiece can be provided with an alarm function in which an alarm time indicating hand can be rotated by the timepiece user to a position indicating a desired alarm time, and detection of coincidence between this alarm time and the current time indicated by the hours and minutes hands can be performed by mechanical means. A switch is usually incorporated to enable the timepiece user either to set the alarm function to cause an alarm signal to be generated at the time indicated by the alarm time indicating hand or to cancel the alarm, so that no alarm signal is generated even when coincidence is detected between the preset alarm time and the current time.

Various methods are possible for indicating to the timepiece user whether the alarm function is in the set status or the cancelled status. In the case of a timepiece of fairly large size, it is possible to use a switch for alarm setting or cancellation which has two visibly different positions. For example, the switch operating member can protrude out of the timepiece case when the timepiece is in the alarm set status, and can be flush with the surface of the case when the timepiece is in the alarm cancel status. The timepiece user can thus determine the alarm set or cancelled status of the timepiece by observing the switch position. In the case of a very small timepiece such as an electronic wristwatch however, such a method is not practical, due to the small size of the switches used in such a timepiece. Various methods have been proposed for indicating whether the alarm function is in the set or cancelled status in an electronic wristwatch of analog display type. Such methods include the provision of an auxiliary electro-optical display area, in which the alarm set/cancel status is indicated. Other methods include the provision of an L.E.D., or a mechanically operated indicator. However such methods result in increased complexity of the timepiece construction, and make it difficult to produce an electronic wristwatch of compact size, since additional components must be incorporated in order to provide the alarm set/cancelled status indication.

With an electronic timepiece in accordance with the present invention, such disadvantages of the previous methods are resolved. Indication is given as to whether the alarm function is in the set or cancelled status by means of modulating the motion of the seconds hand of the timepiece.

This motion can be modulated in various ways. For example, the seconds hand can be rapidly advanced through an angle corresponding to one second on the timepiece dial, rotated back through the same angle, and then rapidly advanced through the same angle, in a series of three rapidly consecutive steps, at the beginning of each seconds unit time interval. Such a modulation method is described herein with respect to a first embodiment of the present invention. It is also possible to advance the seconds hand through two rapidly consecutive steps corresponding to two seconds of time display, once every two seconds. Such a method of indicating the set or cancelles status of the alarm function is extremely economical to implement, since the components utilized, i.e. the seconds hand and the stepping motor and drive circuit, are already available, and little or no additional components are required.

It is therefore an object of the present invention to provide an improved means of indicating the alarm set or alarm cancelled status of an electronic timepiece having an alarm function, with such indication being provided by modulation of the mode of advancement of one of the time indicating hands of the timepiece.

Further objects, features and advantages of the present invention will be made more apparent from the following description, when taken in conjunction with the attached drawings, whose scope is given by the appended claims.

IN THE DRAWINGS

Figure 1:
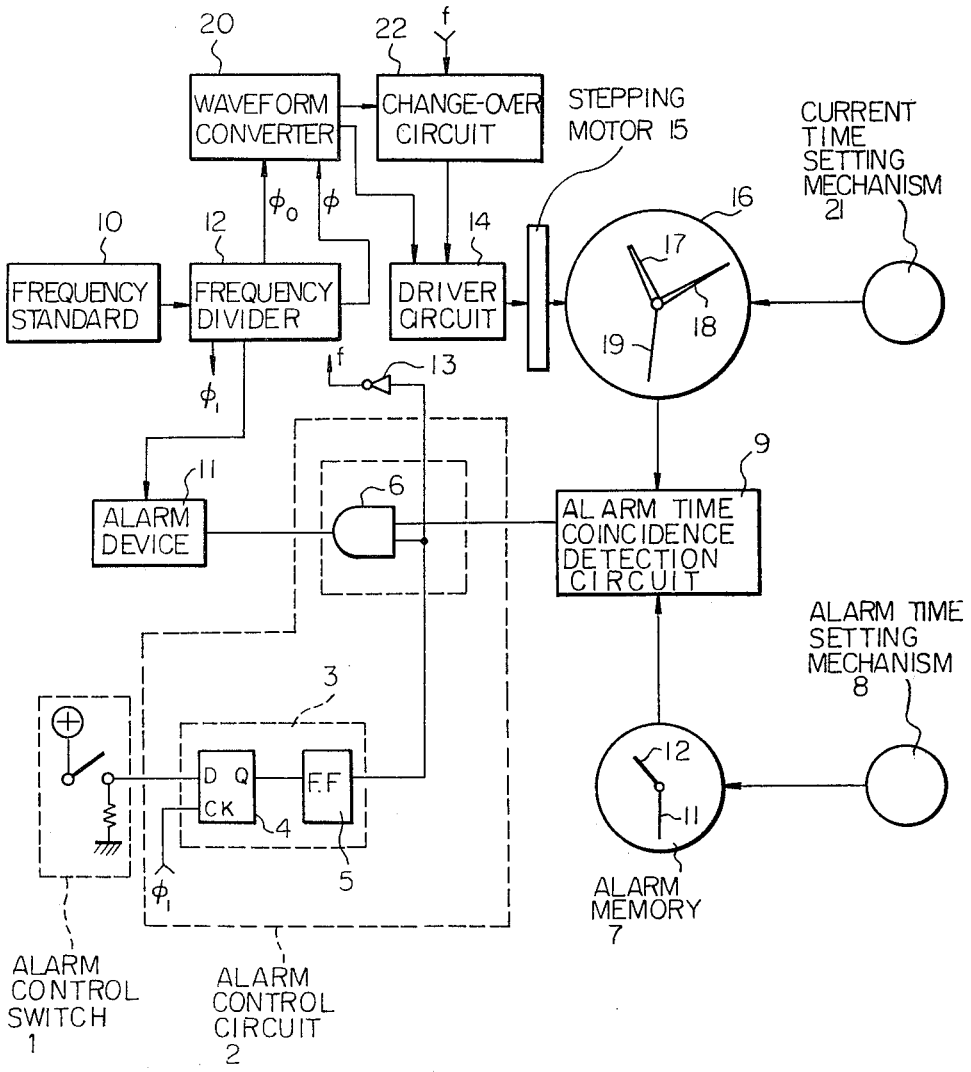
FIG. 1 is a block diagram of a first embodiment of an electronic timepiece in accordance with the present invention.

Referring now to FIG. 1, a first embodiment of an electronic timepiece in accordance with the present invention will now be described. Numeral 1 indicates an alarm control switch, which is actuated by the timepiece user through an external control member. When the alarm control switch 1 is actuated, a high potential signal (i.e. a signal at the high potential logic level of the circuit, which will be referred to hereinafter as the H level) is applied to alarm control circuit 2, and is input to the data terminal of a data-type flip-flop 4 in switch control circuit 3. Clock signal $\phi 1$ is applied from a frequency divider circuit 12, to be described later, to the clock terminal of flip-flop 4, so that the output terminal of flip-flop 4 goes to the H level after switch 1 is actuated, with the effects of switch bounce being eliminated. The H level output signal from flip-flop 4 is applied to the input terminal of flip-flop 5, whose output goes alternately from the H level to the low potential level (referred to hereinafter as the L level) and from the L level to the H level, as successive L level to H level voltage transitions are applied to its input terminal. If we assume that the output from flip-flop 5 was previously at the L level, then actuation of alarm control switch 1 will cause the output of flip-flop 5 to go to the H level. The next actuation of switch 1 will cause the output of flip-flop 5 to go to the L level. The output of flip-flop 5 is applied to an input terminal of an AND gate 6. Numeral 7 indicates an alarm memory, having alarm time hours hand 12, and alarm time minutes hand 11. A desired value of alarm time can be set into alarm memory 7, by the timepiece user actuating alarm time setting mechanism 8, which is coupled to an external actuating member. Alarm memory 7 is of mechanical type.

Numeral 10 indicates a frequency standard, such as a quartz crystal controlled oscillator circuit, which produces a standard frequency signal of relatively high frequency. This signal is applied to a frequency divider 12, which produces first and second low frequency signals $\phi$ and $\phi 0$ which are applied to a waveform converter 20, and a clock signal $\phi 1$ which is applied to alarm control circuit 2, described previously. Waveform converter circuit 20, which is responsive to signals $\phi$ and $\phi 0$ for producing first a train of output pulses composed of single pulses having a period of one second, and a second train of output pulses con consisting of paris of immediately consecutive pulses with a period of one second between each pair of pulses, and with each of these pairs of pulses being produced with a slight delay relative to each of the pulses in the first output pulse train. The first output pulse train is continuously applied to a driver circuit 14. The second output pulse train is applied to a changeover circuit 22, which is controlled by signal f. Signal f is the inverted output from flip-flop 5 of alarm control circuit 2, and when signal f is at the H logic level, the second output pulse train is not applied to drive circuit 14, but when signal f is at the L logic level (i.e. when the timepiece is in the alarm set condition), then the second output pulse train is applied from changeover circuit 22 to driver circuit 14. In this latter case, therefore, a synthesized pulse train will be applied to driver circuit 14, including groups of three immediately consecutive pulses, with a period of one second between each of the groups. Driver circuit 14 drives a stepping motor 15, which drives hours hand 17, minutes hand 18 and seconds hand 19 which are time indicating hands of timepiece dial 16, through a gear train.

Numeral 21 indicates a current time setting time mechanism, by means of which the timepiece user can set time indicating hands 17 and 18 to display the correct value of current time.

Numeral 9 indicates a mechanical type of alarm time coincidence detection unit, which is coupled to the gear train by which stepping motor 15 drives time indicating hands 17, 18 and 19, and is also coupled to alarm memory 7. When coincidence occurs between the current time indicated by hands 17 and 18, and the preset alarm time indicated by alarm time minutes hand 11 and alarm time hours hand 12, then an output signal is generated by alarm time coincidence detection unit 9, and is applied to AND gate 6 of alarm control circuit 2. An alarm device 11 is coupled to the output of AND gate 6, and is actuated to produce an audible warning signal when the output of AND gate 6 goes to the H level.

The operation of the embodiment shown in FIG. 1 will now be described. We shall assume that the timepiece is initially in the alarm cancelled condition, i.e. the output of flip-flop 5 of alarm control circuit 5 is at the L level, so that signal f is at the H level. In this case, when the current time indicated by timepiece hands 17 and 18 coincides with the value of alarm time indicated by alarm time hands 11 and 12 of alarm memory 7, then although an output signal at the H level is produced by alarm time coincidence detection unit 9, the output of AND gate 6 remains at the L level, since the output from flip-flop 5 applied to an input of AND gate 6 is at the L level. In this case too, since signal f is at the H level, the second output pulse train from waveform converter 20 is not applied to driver circuit 14 from changeover circuit 22. Only the first output pulse train, including a train of single pulses, is applied to driver circuit 14, thereby causing stepping motor 15 to advance seconds hand 19 at a rate of one step per second.

If now the timepiece user actuates alarm control switch 1, to cause the alarm set status to be entered, then the output of flip-flop 5 goes to the H level. AND gate 6 is now enabled, so that when the output of alarm time coincidence detection unit 9 goes to the H level due to coincidence being detected between the current time indicated by hands 17 and 18 and the alarm time indicated by hands 11 and 12, then the output of AND gate 6 goes to the H level. Alarm device 11 is thereby actuated to emit an alarm warning signal. In the alarm set status, since signal f from alarm control circuit 2 is at the L level, changeover circuit 22 is caused to apply the second output pulse train from waveform converter 20 to driver circuit 14. As a result, a synthesized pulse train, including groups of three immediately consecutive pulses, is applied to driver circuit 14. Stepping motor 15 is specially constructed in such a way that this pulse train applied to driver circuit 14 causes seconds hand 19 to be advanced through an angle corresponding to one second of time indication by the first pulse in each of said pulse groups, to be rotated backward through the same angle by the second pulse of the pulse group, and to be again advanced by the third pulse of the pulse group. These three consecutive movements of seconds hand 19 are completed within a time of several tens of milliseconds, after the start of each seconds unit time interval. This modulation of the movement of the seconds hand 19 provides a clear indication to the timepiece user that the timepiece is in the alarm set status, and that an alarm warning signal will be generated when coincidence occurs between the current time and the preset alarm time. The user can therefore cancel the alarm set status at any time, by again actuating alarm control switch 1, thereby causing the output of flip-flop 5 to return to the L level. The timepiece is now in the alarm cancelled status, and the seconds hand is now advanced in a normal fashion, i.e. by one step per second.

Figure 2:
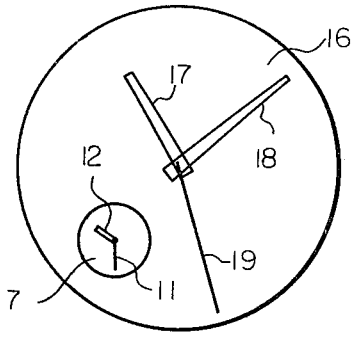
FIG. 2 is a partial view of one example of a dial of an electronic timepiece in accordance with the first embodiment of the present invention.
Figure 3:
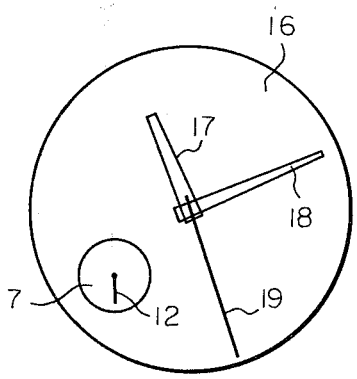
FIG. 3 is a partial view of a second example of a dial of an electronic timepiece in accordance with the first embodiment of the present invention.

FIG. 2 is an example of the appearance of the dial of a timepiece in accordance with the first embodiment of the present invention described above, in which both alarm time hours and alarm time minutes can be set. FIG. 3 shows an example of another timepiece dial, in which only the alarm time hours can be set and indicated, by means of hours hand 12.

Figure 4:
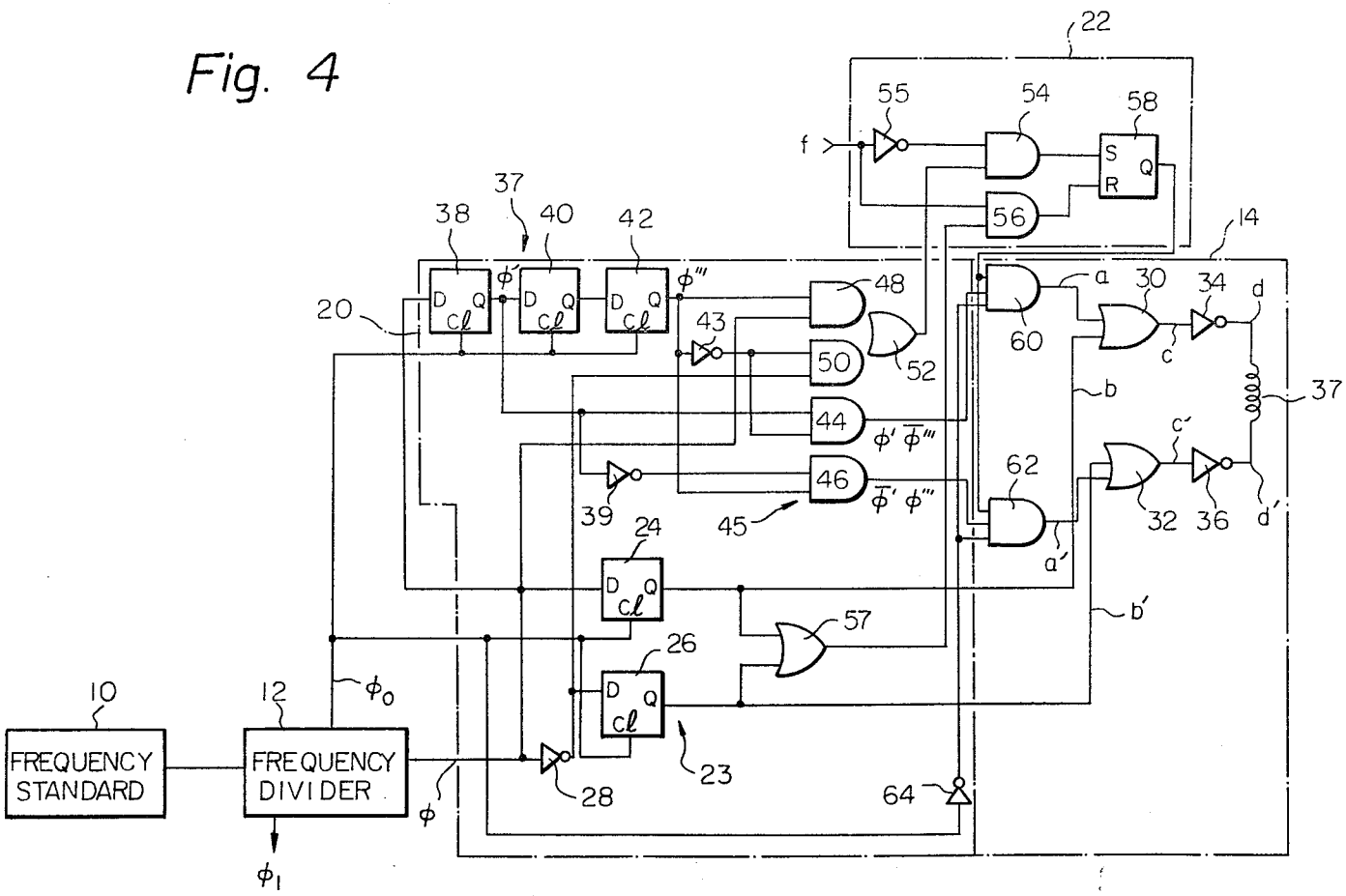
FIG. 4 is a simplified circuit diagram of the first embodiment of the present invention.

An example of detailed circuitry for the waveform converter and changeover circuit of the embodiment shown in FIG. 1 will now be described, with reference to FIG. 4. In FIG. 4, waveform converter circuit 20 includes a first circuit section 23, composed of first and second data-type flip-flops 24 and 26, which trigger on the positive edges of signals applied to their clock terminals. The input and output terminals of an inverter 28 are connected to the data terminals of flip-flops 24 and 26 respectively, while the clock terminals of flip-flops 24 and 26 are connected to the frequency divider 12 to receive signal $\phi 0$. The input of inverter 28 is connected to the frequency divider 12, to receive signal $\phi$. The outputs of flip-flops 24 and 26 are connected to driver circuit 14, which is composed of OR gates 30 and 32, whode outputs are connected to inverters 34 and 36, respectively. The outputs of inverters 34 and 36 are connected to driving coil 37 of stepping motor 15.

Waveform converter 20 also includes a shift register circuit composed of first, second and third date-type flip-flops 38, 40 and 42, which have their clock terminals connected to receive signal $\phi 0$, and which produce output signals $\phi'$ and $\phi'''$ which are delayed in phase relative to signal $\phi 0$ and relative to each other. The phase relationships between these signals may be understood by referring to FIG. 5. Output signal $\phi'$ from first flip-flop 38 is applied directly to one input of an AND gate 44, and is also applied through inverter 39 to an input of AND gate 46. The remaining input of AND gate 44 is connected through an inverter 43 to flip-flop 42, to receive signal $\phi'''$. The remaining input of AND gate 46 is connected directly to the output of flip-flop 42. AND gates 44 and 46 form part of a circuit section 45, and generate output signals $\phi'.\overline{\phi}'''$ and $\overline{\phi}'.\phi'''$ respectively, as shown in FIG. 3. Output $\phi'''$ of flip-flop 42 is directly applied to one input of an AND gate 48., and is also applied through inverter 43 to one input of AND gate 50. The other input of AND gate 48 is coupled to the output of frequency divider circuit 12, to receive signal $\phi$. The other input of AND gate 50 is coupled to the input of inverter 28, to receive the inverse of signal $\phi$. The outputs of AND gates 48 and 50 are coupled to inputs of an OR gate 52, which produces an output signal $\phi'.\phi'''+\overline{\phi}'.\overline{\phi}'''$, that is applied to one input of an AND gate 54 of changeover circuit 22. When signal f is at the L level, then the output of inverter 55 in changeover circuit 22 is at the H level, and thus the output of AND gate 54 goes to the H level when the output of OR gate 52 goes to the H level. If input f goes from the H level to the L level while drive pulses are being generated, this can cause erroneous operation. For this reason, output signal $\phi'.\phi'''+\overline{\phi}'.\overline{\phi}'''$ from OR gate 52 has a pulse width which is less than the inverval between drive pulses or groups of drive pulses. Thus, gates 48, 50 and 52 serve as an erroneous operation preventive circuit. When signal f is at the L level, i.e. the timepiece is in the alarm cancelled status, then since the output of AND gate 54 is connected to the set terminal of set/reset flip-flop 58, the Q output of flip-flop 58 goes to the H level. When the timepiece is placed in the alarm set status, so that signal f goes to the H level, then an L level signal is applied from the output of inverter 55 to AND gate 54, while an H level signal is applied to one input of AND gate 56. The remaining input of AND gate 56 is connected to the output of OR gate 57. The inputs of OR gate 57 are connected to the outputs of flip-flops 24 and 26 respectively. The output of AND gate 56 is connected to the reset terminal of flip-flip 58. The output of flip-flop 58 is connected to inputs of AND gates 60 and 62, to control these gates. AND gates 60 and 62 serve as a compound pulse generator, for generating the second output pulse train, described earlier, on terminals a and a'. Second inputs of AND gates 60 and 62 are connected through an inverter 64 to an in intermediate stage of frequency divider 12, to receive the inverse of signal $\phi 0$. The third inputs of AND gates 60 and 62 are coupled to the outputs of AND gates 44 and 46 respectively. The outputs of AND gates 60 and 62 are connected to the remaining inputs of OR gates 30 and 32 in driver circuit 14.

The operation of the circuitry shown in FIG. 4 is as follows. If the alarm control switch 1 is actuated to put the timepiece into the alarm cancelled status, then signal f goes to the H level, so that the output of inverter 55 goes to the L level. The output of AND gate 54 is therefore at the L level. In this case, the outputs of flip-flops 24 and 26 are applied through OR gate 57 to AND gate 56, which generates an H level output to reset flip-flop 58, so that the output of change-over circuit 22 is at the L level. Thus, the compound pulse generator composed of AND gates 60 and 62 produces a continuous L level output on terminals a and a'. In these circumstances, flip-flops 24 and 26 of waveform converter circuit 20 produce output pulses on terminals b and b', with the waveforms shown in FIG. 5, in response to first low frequency signal $\phi$. These output pulses are applied through OR gates 30 and 32 to to driving inverters 34 and 36, to generate the normal driving current pulses. In this case, signal pulses are alternately applied from drive circuit 14 inverters 34 and 32, with a period of one second. Thus, stepping motor 15 is driven stepwise to advance seconds hand 19 at a rate of one step per second, thereby driving minutes and hours hands 18 and 17 to display the current time.

Figure 5:
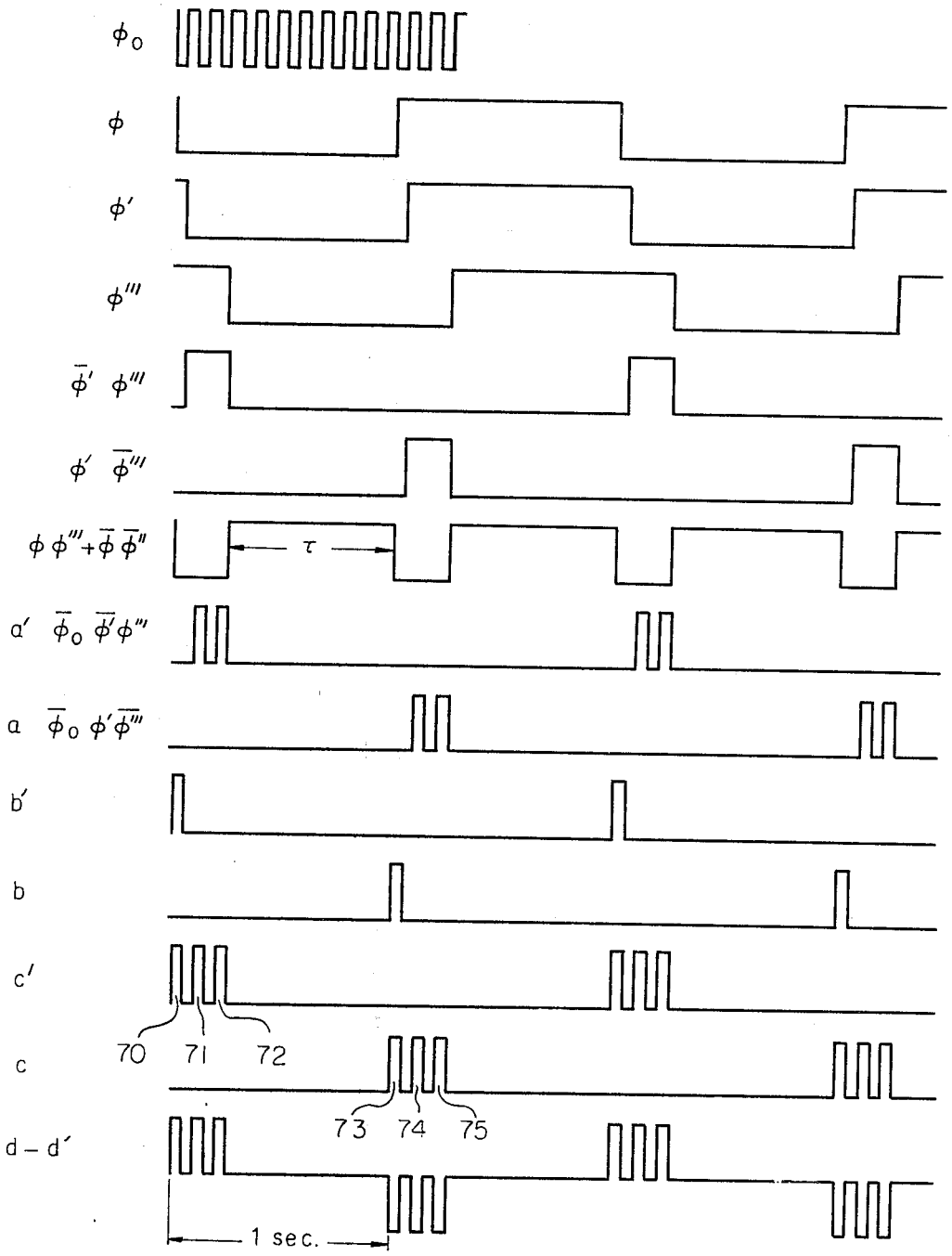
FIG. 5 is a waveform diagram for the circuit diagram shown in FIG. 4.

If the timepiece user now actuates alarm control switch 1 to put the timepiece into the alarm set status, then signal f goes to the L level, so that AND gate 56 is inhibited. At the same time, the output of inverter 55 goes to the H logic level, causing AND gate 54 to be enabled in response to the output of OR gate 52 of the erroneous operation prevention circuit, to pass the output of inverter 55 to the set terminal S of flip-flop 58. Flip-flop 58 is therefore set, and the output of changeover circuit 22 goes to the H logic level. This output is applied to AND gates 60 and 61 of the compound pulse generator, which is enabled to provide compound output pulses $\phi o\phi'.\overline{\phi}'''$ and $\overline{\phi o\phi'}.\overline{o}'''$ at terminals a and a'. These output pulses are applied to OR gates 30 and 32, to which output pulses from terminals b and b' are also applied. The OR gates 30 and 32 serve as synthesizing means which provide synthesized pulses 70 to 72 and 73 to 75 at terminals c and c', as shown in FIG. 5. The synthesized pulses are applied to the driving coil 37 of the stepping motor 15, which is thereby caused to step through an angle corresponding to one second as indicated by seconds hand 19, to step back through the same angle, and then step forward by the same angle, all within several milliseconds. In other words, the rotor of stepping motor 15 is rotated clockwise, counter-clockwise, and clockwise again, in first, second and third steps respectively, with each step having an interval corresponding to one second.

Figure 6A:
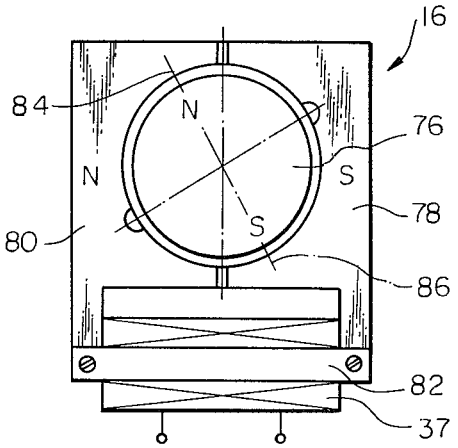
FIG. 6A is a diagram of a stepping motor suitable for use in an electronic timepiece in accordance with the present invention.
Figure 6B:
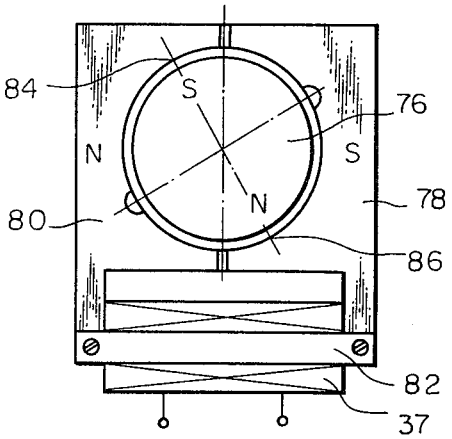
FIG. 6B is a diagram illustrating the stepping motor shown in FIG. 6A, with the rotor of the stepping motor rotated to a different position.
Figure 7:
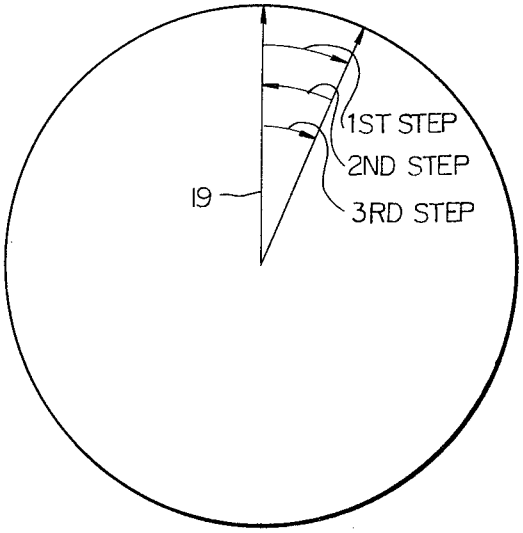
FIG. 7 is a diagram illustrating the motion of the seconds hand of an electronic timepiece in accordance with the first embodiment of the present invention.

FIGS. 6A and 6B show an example of stepping motor 15 suitable for being driven by the modulated driving pulses mentioned above. In FIG. 6A, the stepping motor 15 comprises a permanent magnet rotor 76, stators 78 and 80, and the driving coil 37. In FIG. 6A, pulse 70 from terminal c', shown in FIG. 5, is applied to driving coil 37 causing a current to flow through the driving coil. This brings stator 78 to a state of South magnetization such that rotor 76 rotates clockwise in the first step, as shown in FIG. 6B. In FIGS. 6A and 6B, reference numeral 82 denotes the core of driving coil 37, and numerals 84 and 86 denote the points of static equilibrium. When pulse 71 arrives under these conditions, stators 78 and 80 are excited, and brought to the same status of magnetization as mentioned above, so that rotor 76 now rotates counter-clockwise in the second step, as shown in FIG. 7, and returns to the attitude shown in FIG. 6A. When pulse 72 arrives, the stators 78 and 80 are once again brought to respective states of South and North magnetization, and the rotor 76 thus rotates in a third step, as shown in FIG. 7, returning to the attitude shown in FIG. 6B. Thus, in this fashion, the rotor rotates between points of static equilibrium.

This clockwise-counterclockwise rotation is used to modulate the motion of seconds hand 19 of the timepiece, shown in FIG. 1, which is coupled through the dial train to the stepping motor 15 such that the seconds hand follows this clockwise-counterclockwise movement. This modulated movement can be completed within several tens of milliseconds.

One second after the initial pulse 70 has been applied, pulse 73 arrives and brings the stator 78 to a state of South magnetization whereby the rotor 76 rotates clockwise and assumes the attitude shown in FIG. 6A. When pulse 74 arrives under this condition, stators 78 and 80 are once again brought to respective states of North and South magnetization, so that the rotor 76 now rotates counter-clockwise, to the attitude shown in FIG. 6B. When the pulse 75 arrives, the same states of magnetization are again induced and the rotor 76 thus rotates clockwise to the attitude shown in FIG. 6A. Again the rotor 76 rotates between points of static equilibrium. As was previously the case, this clockwise-counterclockwise rotation modulates the movement of the seconds hand, in other words the seconds hand follows this clockwise-counter-clock wise rotation. This operation continues in a repetitive manner, modulating the motion of the seconds hand 19 of the timepiece to indicate that the timepiece has been placed in the alarm set status.

Figure 8:
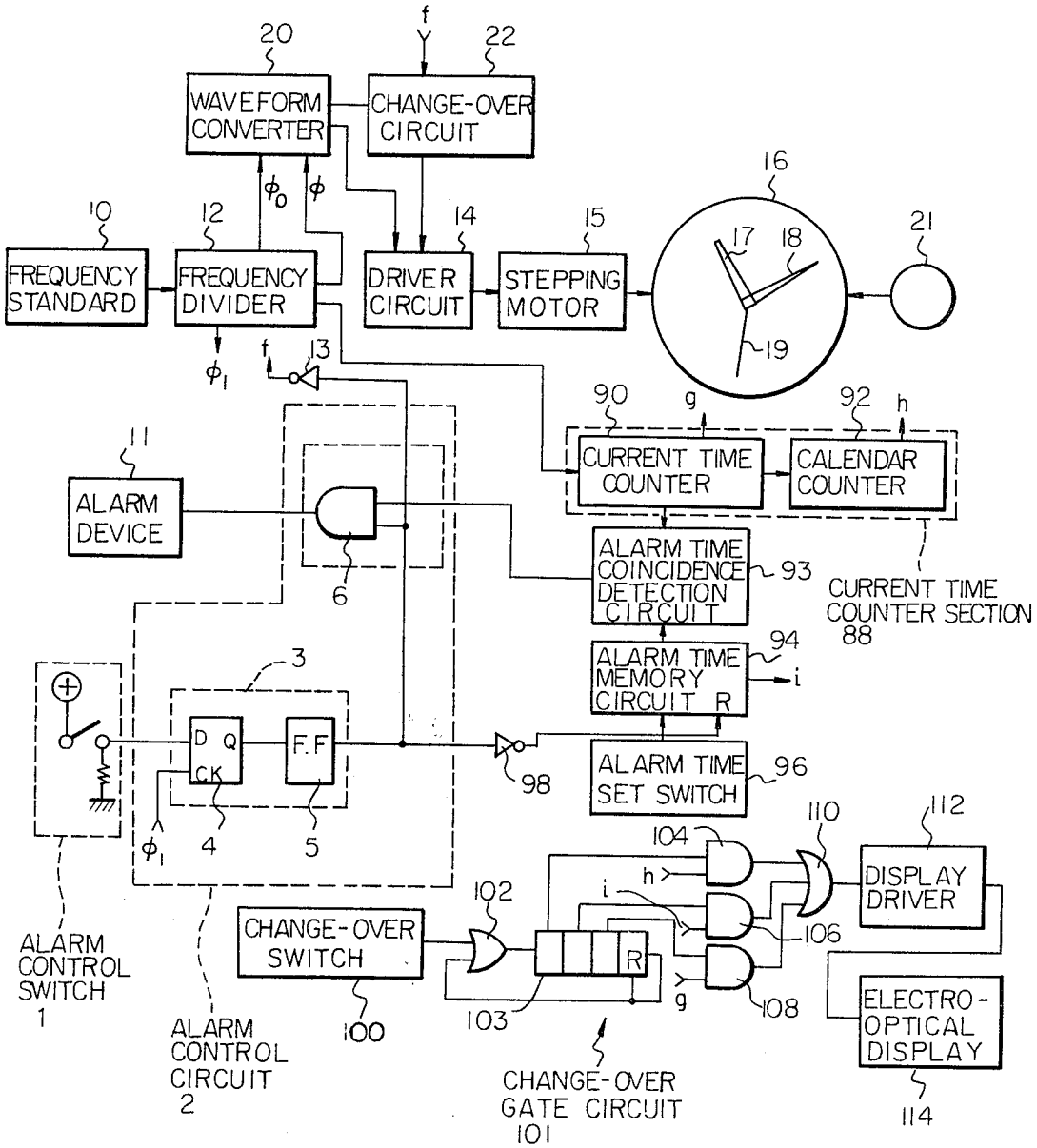
FIG. 8 is a general block diagram of a second embodiment of an electronic timepiece in accordance with the present invention, incorporating an electro-optical display section.

A second embodiment of the present invention will now be described with reference to FIG. 8. In the embodiment shown in FIG. 8, alarm control switch 1, alarm control circuit 2, waveform converter 20 and changeover circuit 22 are of similar configuration, and have identical functions, to the sections with identical numerals shown in FIG. 1, and described above with respect to the first embodiment of the present invention. However in the case of the embodiment shown in FIG. 8, the alarm time is memorized in an alarm time memory circuit 94, into which the alarm time is set by successive actuation of alarm time set switch 96, which is coupled to an external actuating member. Further, a unit time signal produced by frequency divider circuit 12 is counted electronically by means of a current time counter section 88, which counts the minutes and hours of current time, in a time counter 90, and counts the days of the week and the days of the month in a calendar counter 92. Coincidence between the current time stored in the time counter 90 and the alarm time stored in alarm time memory circuit 94 is detected electronically by means of alarm time memory circuit 93, which is coupled to time counter section 90 and alarm time memory circuit 94. When coincidence is detected, then as in the case of the first embodiment described above, an H level output is applied from alarm time coincidence detection circuit 93 to an input of AND gate 6 in alarm control circuit 2, causing alarm device 11 to generate an alarm warning, unless the timepiece has been placed in the alarm cancelled status in which AND gate 6 is inhibited.

The output of flip-flop 5 in alarm control circuit 2 is applied through inverter 98 to the reset terminal of alarm time memory circuit 94. This causes the contents of alarm time memory circuit 94 to be reset to zero when the timepiece is placed in the alarm cancelled mode, since in this condition the output of inverter 98 is at the H level.

Changeover switch 100 is used to select either a preset alarm time (stored in alarm time memory circuit 94) the current time hours and minutes (from current time counter 90) or the day of the week and date (from calendar counter 92) to be displayed on the opto-electronic display 114 of the timepiece. Changeover switch 100 is coupled to the input of an OR gate 102, whose output is connected to the input of a four-stage shift register 103. The output of the first stage of shift register 103 is coupled to an input of an AND gate 104, while the output of calendar counter 92 is applied (in time serial form) to the other input of AND gate 104. The output of the second stage of shift register 103 is coupled to an input of AND gate 106, while the output i of alarm time memory circuit 94 is applied to the other input of AND gate 104. The output of the third stage of shift register 103 is coupled to an input of AND gate 108, while the output g of current time counter section 90 is applied to the other input of AND gate 108. The fourth stage of shift register 103 is connected to a reset input of that fourth stage, and also, through OR gate 102, to the input applied to the first stage of shift register 103. If we assume that the output from the first stage of the shift register 103 is at the H level, so that AND gate 104 is enabled, then if changeover switch 100 is actuated once, the resultant L level to H level transition appearing at the output of OR gate 102 causes the second stage of shift register 103 to go to the H level, while the first stage output goes to the L level. In this state, AND gate 106 is enabled, while AND gates 104 and 108 are inhibited. If changeover switch 100 is actuated once more, then the output of the third stage of shift register 103 goes to the H level, while the output of the second stage returns to the L level. In this condition, AND gate 108 is enabled, while AND gates 104 and 106 are inhibited. If changeover switch 103 is actuated once more, then the output of the fourth stage of shift register 103 goes momentarily to the H level, but is rapidly reset by being applied to its own reset input. However before the output of the fourth stage returns to the L level, it produces a momentary H level output from OR gate 102, causing the first stage of shift register 103 to go to the H level once more. Thus, by successively actuating changeover switch 100, any desired one of AND gates 104, 106 and 108 can be selected to be enabled. The outputs of AND gates 104, 106 and 108 are applied to an OR gate 110, whose output is applied to a display driver 112. The output of display driver circuit 112 drives an electro-optical display 114, to display either the alarm time, current time, or date, in accordance with actuation of changeover switch 100. Shift register 103, in conjunction with AND gates 104, 106 and 108, and OR gates 102 and 110, constitute a changeover gate circuit.

Figure 9A:
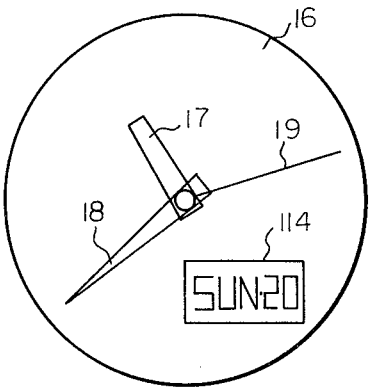
FIGS. 9A, 9B, 9C, and 9D are partial views of the dial of an electronic timepiece in accordance with the second embodiment of the present invention.
Figure 9C:
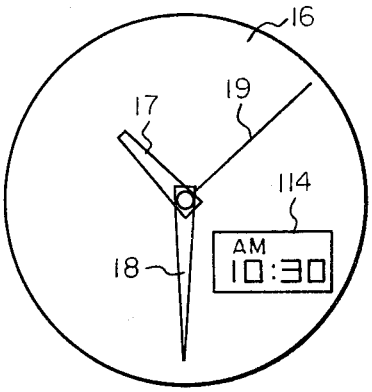
Figure 9B:
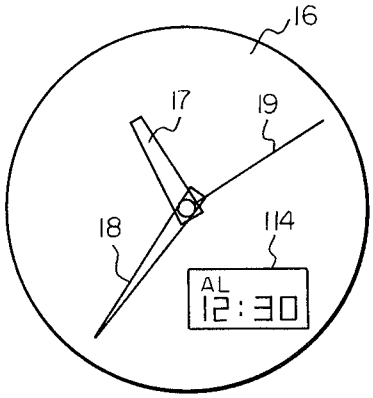

FIGS. 9A, 9B, 9C and 9D show the appearance of an example of a dial for the second embodiment described above. Reference numeral 114 indicates an electro-optical display, driven by display driver 112. As in the case of the first embodiment the seconds hand 19 is normally advanced by one step per second, i.e. when the timepiece is in the alarm cancelled status, but is stepped in a clockwise-counterclockwise-clockwise sequence, once per second, to indicate that the timepiece is in the alarm set status. Numerals 17 and 18 indicate the hours and minutes hands respectively. In FIG. 9A, the day of the week and day of the months are displayed by electro-optical display 114. In this condition, the first stage of shift register 103 is at the H level, so that AND gate 104 is enabled to pass output h of calendar counter 92 to display driver 112. If the user now actuates changeover switch 100, then the second stage output of shift register 103 goes to the H level, while the first stage output goes to the L level, so that AND gate 106 is enabled to pass output i from alarm time memory circuit 94 to the display driver 112. In this case, therefore, the memorized alarm time is displayed on electro-optical display 114, as shown in FIG. 9B.

If changeover switch 100 is again actuated in this condition, then the output of the third stage of shift register 103 goes to the H level, so that AND gate 108 is enabled to pass the output g of current time counter 90 to display driver 112. In this case, therefore, the current time is displayed by electro-optical display 114, as shown in FIG. 9C, so that the time indicating hands and the electro-optical display 114 display the same time value.

Figure 9D:
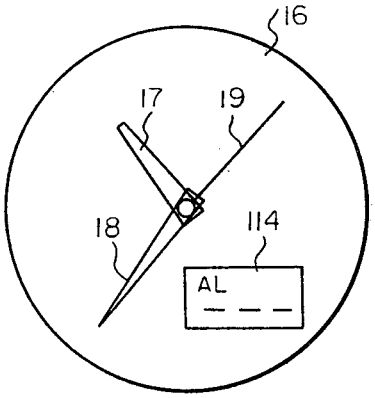

If changeover switch 110 is actuated to cause the alarm time to be displayed in the condition in which the timepiece is in the alarm cancelled status, i.e. when the contents of alarm time memory circuit 94 have been reset to zero, then the appearance of electro-optical display 114 is as shown in FIG. 9D. Since the alarm time is indicated as being blank, a further indication is given to the user that the timepiece is in the alarm cancelled status, in addition to the fact that the seconds hand 19 is being advanced normally at a rate of one step per second.

Although the above embodiment, both modulation of the movement of seconds hand 19 and an electro-optical display are provided, it is also possible to omit the arrangement for modulating the seconds hand movement, and to provide only the electro-optical display to indicate to the user whether the timepiece is in the alarm set or the alarm cancelled status. In other words, if the user actuates changeover switch 100 to cause the memorized alarm time to be displayed, and only blanks are displayed, then this is an indication that the alarm cancelled mode has been entered. If on the other hand a value of time is displayed in this case, then this indicates that the timepiece is in the alarm set status.

In addition, although in the first and second embodiments of the present invention a method of modulating the seconds hand motion is utilized whereby the seconds hand is alternately stepped clockwise, counterclockwise and clockwise again, by three rapidly consecutive steps once per second, various other methods of modulating the seconds hand motion can be adopted. For example, the seconds hand can be caused to advance by two consecutive steps, each corresponding to one second of time indication, once every two seconds, in order to indicate that the timepiece is in the alarm set status. It is equally possible to indicate the normal operating status by advancing the seconds hand by a multiple number of steps per unit time interval, for example by two immediately consecutive steps in every two seconds, and to indicate the alarm set status by advancing the seconds hand once per second. It is also possible to utilize a method of modulating the advancement of the seconds hand whereby the seconds hand is advanced continuously to indicate one status and is advanced in stepwise fashion to indicate the other status of the timepiece.

Thus, although the present invention has been shown and described with respect to a particular embodiment, it should be understood that various modifications may be made, and that such modifications fall within the scope claimed for the present invention.

What is claimed is:

1. An electronic timepiece comprising:

a frequency standard for providing a standard frequence signal;

a frequency divider for providing relatively low frequency signals in response to said standard frequency signal;

timekeeping counter circuit means for producing signals indicative of at least hours and minutes of current time information;

an alarm time memory circuit for storing alarm time information;

an alarm time coincidence detection circuit for detecting coincidence between said alarm time information and said current time information and for generating a coincidence signal indicative of such coincidence;

alarm warning signal generation means;

an externally actuated alarm control switch;

alarm control circuit means responsive to actuation of said alarm control switch for producing an output signal indicative of an alarm set status, said output signal acting to enable said alarm warning signal generation means to be activated by said coincidence signal;

an externally actuated changeover switch;

electro-optical display means;

changeover gate circuit means responsive to actuation of said changeover switch for selectively applying said current time information and said alarm time information to said electro-optical display means to be displayed thereby;

drive signal generation circuit means coupled to receive said relatively low frequency signals from said frequency divider circuit, and responsive to actuation of said alarm control switch for selectively producing a first drive signal comprising a single drive pulse occurring once in each of a series of predetermined time intervals and a second drive signal comprising a sequentially generated plurality of drive pulses occurring once in each of said predetermined time intervals;

a stepping motor having a rotor, and responsive to said first drive signal for advancing said rotor through a predetermined angle once in each of said predetermined time intervals, and responsive to said second drive signal for sequentially advancing said rotor through said predetermined angle a plurality of times in each of said predetermined time intervals; and time indicating display means including time indicating hands coupled to be driven by said rotor;

said time indicating hands being thereby advanced in a regular and periodic manner when said alarm control switch has been actuated such that said timepiece is in a normal operating mode, and at least one of said time indicating hands being driven in a modulated manner when said alarm control switch has been actuated such that said timepiece is in an alarm set mode, whereby visible indication is provided to distinguish said normal operating mode and said alarm set mode.

2. An electronic timepiece according to claim 1, wherein said at least one time indicating hand is moved at least once in a forward direction and at least once in a reverse direction during each of said predetermined time intervals, when being driven in said modulated manner.

3. An electronic timepiece according to claim 1, wherein said timekeeping counter circuit means further produces signals indicative of calendar information.

4. An electronic timepiece according to claim 3, wherein said changeover gate circuit means is responsive to successive actuations of said changeover switch for selectively applying said hours and minutes current time information, said alarm time information, and said calendar information to said electro-optical display means to be displayed thereby.

5. An electronic timepiece according to claim 1, in which each of said predetermined time intervals is of one second duration.

* * * * *

UNITED STATES PATENT AND TRADEMARK OFFICE

CERTIFICATE OF CORRECTION

PATENT NO. : 4,253,172

DATED : February 24, 1981

INVENTOR(S) : YASUSHI NOMURA

It is certified that error appears in the above-identified patent and that said Letters Patent are hereby corrected as shown below:

In item [54],

"OR" SHOULD BE --OF--

Signed and Sealed this

Nineteenth Day of May 1981

[SEAL]

*Attest:*

RENE D. TEGTMEYER

*Attesting Officer*

*Acting Commissioner of Patents and Trademarks*